US006000330A

United States Patent [19]

Farb et al.

[11] Patent Number: 6,000,330

[45] Date of Patent: Dec. 14, 1999

[54] LINE PRINTER WITH REDUCED MAGNETIC PERMEANCE

[75] Inventors: Norman E. Farb, Villa Park; John Stanley Kinley, Costa Mesa, both of Calif.

[73] Assignee: Printronix, Inc., Irvine, Calif.

[21] Appl. No.: 09/161,208

[22] Filed: Sep. 25, 1998

[51] Int. Cl.[6] ..... B41J 2/245

[52] U.S. Cl. ..... 101/93.04; 400/124.2

[58] Field of Search ..... 101/93.04, 93.05; 400/124.17, 124.18, 124.19, 124.2

[56] References Cited

U.S. PATENT DOCUMENTS

| | | | |
|---|---|---|---|
| 4,882,987 | 11/1989 | Sakai et al. | 101/93.04 |
| 5,344,242 | 9/1994 | Farb | 400/124.2 |
| 5,743,665 | 4/1998 | Ryan et al. | 400/323 |

FOREIGN PATENT DOCUMENTS

| | | | |
|---|---|---|---|
| 61-193868 | 8/1986 | Japan | 101/93.03 |

*Primary Examiner*—Christopher A. Bennett
*Attorney, Agent, or Firm*—George F. Bethel

[57] ABSTRACT

An impact printer and method of printing having a plurality of hammers in side-by-side relationship with pairs of pole pieces in associated relationship with each hammer with a hammer contact end and a distal end removed from the hammer contact. A pair of elongated magnets span the pole pieces at their distal ends and a magnet connection connects the magnets for creating a magnetic circuit through the pole pieces. The pole pieces have reduced adjacent facing areas at their distal ends, and are reduced in cross-section intermediately between their ends. The reduction in area between pole pieces directly reduces the permeance and mutual induction thereby creating greater accuracy of printing by the hammers.

29 Claims, 4 Drawing Sheets

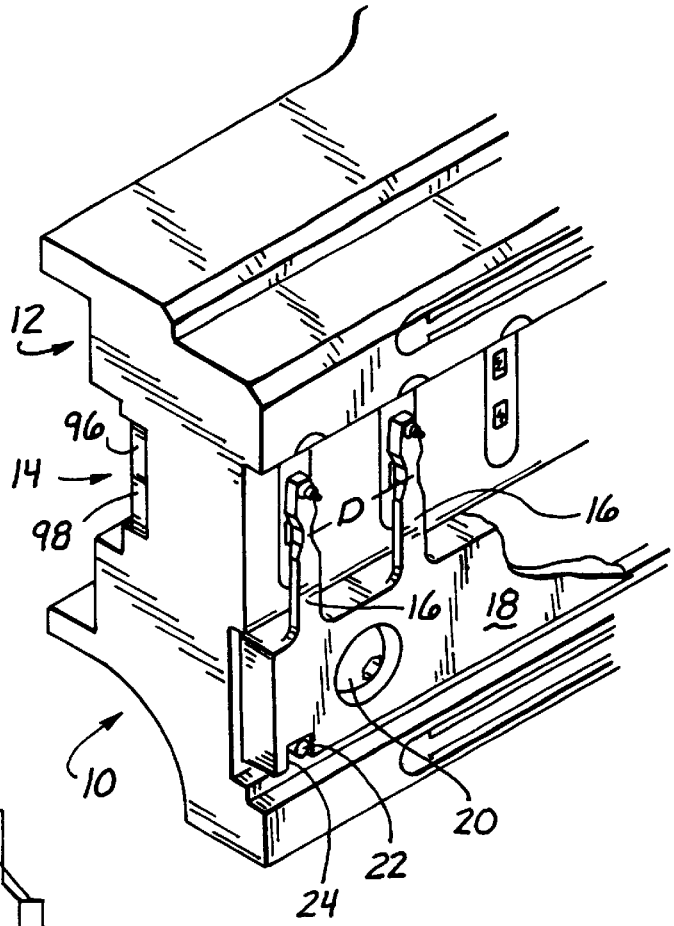
Fig. 1
Fig. 7
PRIOR ART
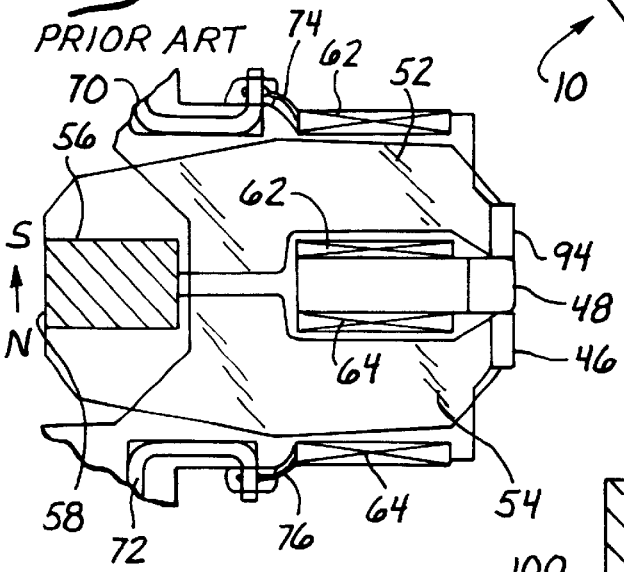
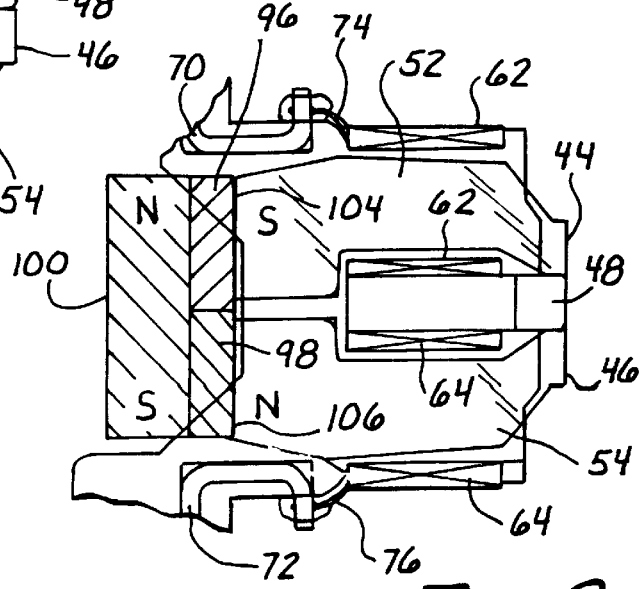
Fig. 8

LINE PRINTER WITH REDUCED MAGNETIC PERMEANCE

BACKGROUND OF THE INVENTION

1. Field of the Invention

The field of this invention lies within the field of dot matrix printers. More particularly, the field lies within the art of dot matrix printers which are characterized as line printers having a series of hammers that are released from a hammerbank. The hammerbank has permanent magnets for retention of the hammers, and electrical coils to overcome the magnetic retention by reversing the polarity for releasing the hammers. It particularly relates to that aspect of the magnetics which permanently retain the hammers and interact with adjacent magnetic forces including those of the pole pieces.

2. Prior Art

The prior art of line printers with permanent magnets incorporates numerous magnetic orientations. Oftentimes, these magnetic orientations are such where an elongated bar magnet is used to cause a pair of pole pieces to retract a hammerspring. The pole pieces are such wherein they receive a permanent magnet between them.

The pole pieces can be oriented so as to have shunts and air gaps for modifying the action of the permanent magnets. However, by in large, such permanent magnetism is provided by a magnet which is placed in a notch, space, or slot between pairs of pole pieces. The magnetism flows from the permanent magnet through the pair of pole pieces for retracting the hammer against the pole pieces.

Coils are wrapped around the pole pieces and overcome the permanent magnetism of the magnetic circuit so that a release of the sprung hammers of the hammerbank can be effected. This is when the permanent magnetism is counteracted so that the hammers are released and move away by their spring action from the ends of the pole pieces. During this release action, the permanent magnetism and the reverse flux provided by the coils creates a dynamic within the interaction of the hammers and the interfacing adjacent pole pieces. This interaction within the hammers is such that magnetic phenomena dynamically changes between the hammers, the pole pieces, and the magnetic circuit.

The dynamic interaction is extremely critical to the phases of printing. When the hammers are released, the relative phases of printing, as the hammers each respectively strike the print ribbon and the underlying media, can vary depending on the magnetic interaction between adjacent hammers and pole pieces. As can be appreciated, if the hammers are released too slowly, too quickly, or magnetically retracted in a particularly variable manner without consistency, the dots in a line matrix printing or other dot matrix printer are not accurate and do not present clear print. This is most critical with regard to such items today as bar codes that are printed onto an underlying media for bar code reading.

The position of a hammerspring in contact or when away from a pole piece affects the magnetics, and magnetic forces are imposed on the other hammerspring magnetic circuits. These interactive changes during the operation of the hammerspring is a major problem. When such interaction takes place, it tends to occlude and change the desired operating characteristics of the magnetics and attendant hammersprings. Such interaction, can create a cascading effect. The magnetic effects of one hammerspring and magnetic circuit of the pole pieces can be transferred to another one. Likewise, down the line of a plurality of hammersprings and magnetic pole pieces, a cascading effect is created in a line printer thereby affecting them on a cascading basis.

The foregoing cascading effect can vary depending upon the dynamics of operation. For instance, if one particular series of adjacent springs are releasing and retracting, they can effectively create a cascade effect in an adjacent relationship. To this extent, they can change the magnetic effects on a constantly shifting basis. As a consequence, if this problem can be resolved or reduced it is eminently helpful to the accuracy and functions of a printer, especially a printer printing bar codes.

When viewing the hammers and the pole pieces, it can be determined that permeance exists between them. In effect, the magnetic flux can transit or leap from one pole piece to a neighboring pole piece or pole pin. This permeance is inversely proportional to the distance between the pole pieces. In other words the farther they are away in spacing, the less the permeance and effect of mutual inductance has on the magnetic circuits. Further to this extent, the permeance is directly proportional to the adjacent or facing areas of neighboring pole pins or pole pieces. In other words, as the adjoining or adjacent area of the pole pieces increases, there is a directly proportional increase of magnetic permeance between the pole pieces or pins.

In order to overcome these deficiencies a decrease in the adjacent areas is utilized to resolve the problem. This is effected by removing a portion of the pole pieces or pole pins having areas in adjacent relationship to each other. By doing this, the characteristics of the permeance between the adjacent pole pieces is diminished. In effect, the connection of the magnetic flux of the permanent magnets to the pole pieces is diminished and more discrete and precise printing operations can be effected.

In order to provide for this decrease in permeance through reduced adjacent areas, the surface areas are diminished. Also the magnetics provided by the permanent magnet are split. The split magnet is interconnected by a keeper in order to provide for connected magnetic functions through the magnetic circuit.

The reduced permeance of the pole pieces to neighboring pole pieces results in reduced mutual and self inductance. Thus, the changes in forces on a hammerspring in the released and retracted positions or during the dynamic movement as well as in the static position upon return is reduced as to neighboring pole pieces.

The changes in dynamic magnetic pull back forces in the hammers and pole pieces because of the positions of neighboring hammersprings is one of the worst case conditions. This is particularly true when the hammerspring spacing between them is reduced which in turn creates greater permeance. To solve this, this invention specifically reduces the geometry of the pole pins as to their mutual facing areas, and reduces self and mutual inductance through the reduction of permeance. In this manner, faster circuits are achieved that are better matched for the timing and voltage levels to allow for less energy per stroke to be consumed from the power supply and more accurate printing. As a consequence, this invention is a broad step over the prior art by increasing speed and accuracy of printing as well as reducing the power requirements.

SUMMARY OF THE INVENTION

In summation, this invention comprises a new orientation for the permanent magnets of a line printer and the respective pole pieces enhanced by reducing interfacing areas between pole pieces to reduce permeance while at the same time providing a permanent magnet that has been split for connection thereto held by a magnetically conductive keeper.

More specifically, the invention comprises a line printer having pole pieces. The pole pieces retain a hammer having a pin thereon for impingement against a print ribbon to print a dot on an underlying media. The pole pieces are reduced in overall size and particularly as to their facing areas. By reducing the facing areas, the respective permeance between them is also reduced.

Attached to each pole piece is a permanent magnet that has been split so as to provide continuity of a magnetic circuit. The magnet splitting is enhanced by a keeper which maintains the magnetic circuit with proper flow characteristics while at the same time reducing the amount of permeance between the respective pole pieces.

By reducing the areas mutually exposed respectively between each pole piece, a diminishing of the overall permeance is provided and a decreased spacing between the pole pieces can be effected. Further to the extent of decreasing the spacing between the pole pieces is the enhanced characteristics of reducing mutual induction. Thus greater accuracy and printing quality can be accomplished with improved dot placement.

A further enhancement is the reduction in power consumption, and greater relative control of the hammers of the hammerbank is effectuated to a more finite degree. As a consequence, this invention is a substantial step over the prior art as to both design, inventive configuration and attendant operational features as will be seen in the following specification.

BRIEF DESCRIPTION OF THE DRAWINGS

FIG. 1 shows a fragmented perspective view of a hammerbank of a line printer showing two hammers and the ends of the pole pieces of this invention.

FIG. 7 shows the prior art of the invention analogous to that seen in FIG. 6 without the schematic reduction of the facing surface area.

FIG. 8 shows a side sectional elevation view of the invention hereof with the split magnets and keepers in place.

DESCRIPTION OF THE PREFERRED EMBODIMENTS

Figure 2:
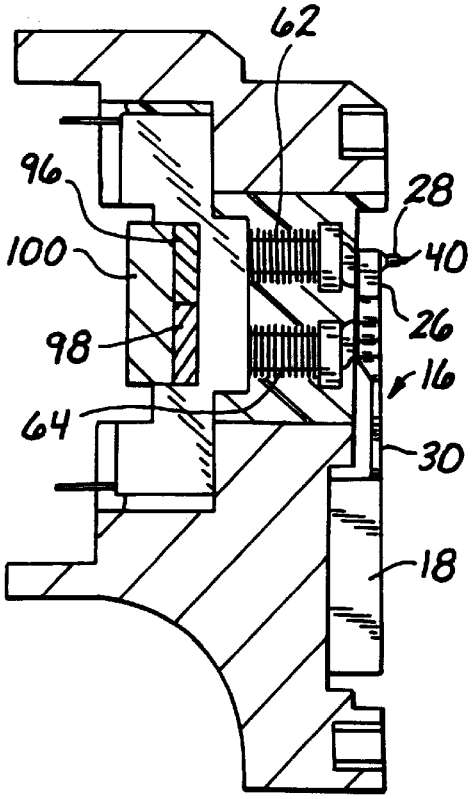
FIG. 2 shows a sectional view of the hammerbank, permanent magnets and coils with a hammer.

Looking specifically at FIG. 1, it can be seen that a hammerbank portion in the form of a fragmented segment toward the end of the hammerbank is shown. The fragmented portion of the hammerbank is a segment that is cut from an elongated hammerbank having approximately anywhere from forty to one hundred print hammers more or less that can be retained and then fired or released against a print ribbon as is well known in the art.

The hammerbank 10 is such wherein the base or shuttle is generally machined or cut from an elongated metal portion such as an aluminum casting or extrusion, or formed in any other suitable manner to provide for an elongated mounting of the hammers on the hammerbank. In this particular case, it can be seen that the hammerbank has an area 12 which can receive an elongated circuit board or other controlling means such as in U.S. Pat. No. 5,743,665 dated Apr. 8, 1998. Also, the hammerbank has an elongated channel or groove 14 which receives the split permanent magnets of this invention as will be described hereinafter.

As is customary in printer hammerbanks, they can comprise a series of hammers 16 connected to and formed on a fret 18. The fret 18 is secured to the hammerbank by screws, nuts or bolts or any other securement means shown generally as screw 20. For proper indexing, an indexing pin 22 is provided in order to allow a slotted portion 24 of the fret 18 to be indexed thereagainst for securement.

The hammers 16 comprise an enlarged portion 26 to which a pin 28 is welded, brazed or otherwise connected thereto. The enlarged portion 26 terminates in a necked down spring portion 30 connected to and formed with the fret 18. This entire structure and shape of the hammers 16 can be configured in other suitable manners to allow for the dynamics of printing as is understood in the art.

Each pin 28 has a reduced tip 40. The reduced tip 40 is the portion that is impacted against a ribbon in order to provide for forming a dot matrix printing array, pattern, alpha numeric symbols, Oriental style lettering, a particular pattern, or pictorial representation.

In order to retain the hammers which are sprung for printing movement away from the hammerbank, a permanent magnetic force is applied through a pair of pole pins, pole pieces, or pole members which provide the magnetic circuit. These terminate in upper and lower pole piece termination sections, hammer contacts, terminals or pins, 44 and 46. These pole piece terminal portions 44 and 46 are generally provided with a surface 48 therebetween against which a hammer 16 can be retracted and creates an impact or wear surface.

Figure 6:
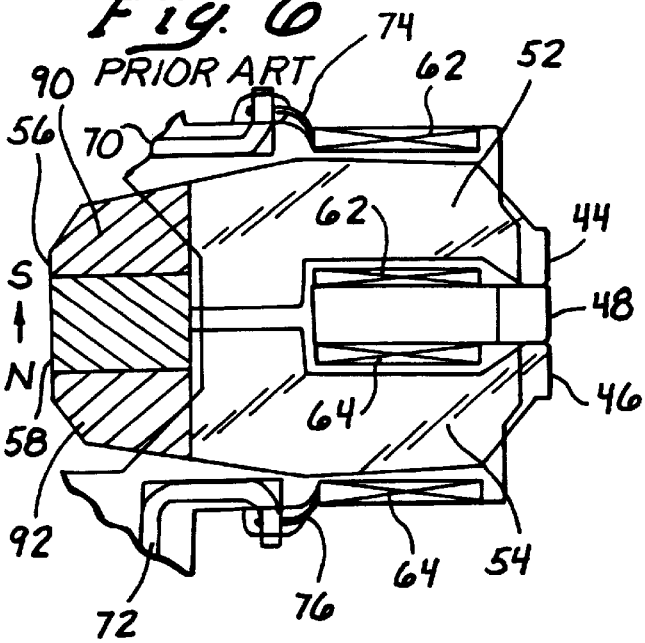
Fig. 6 PRIOR ART
FIG. 6 shows a sectional schematic view of the prior art and the relative facing areas of the pole pieces that exist between respective pole pieces that has been reduced by this invention.
Figure 4:
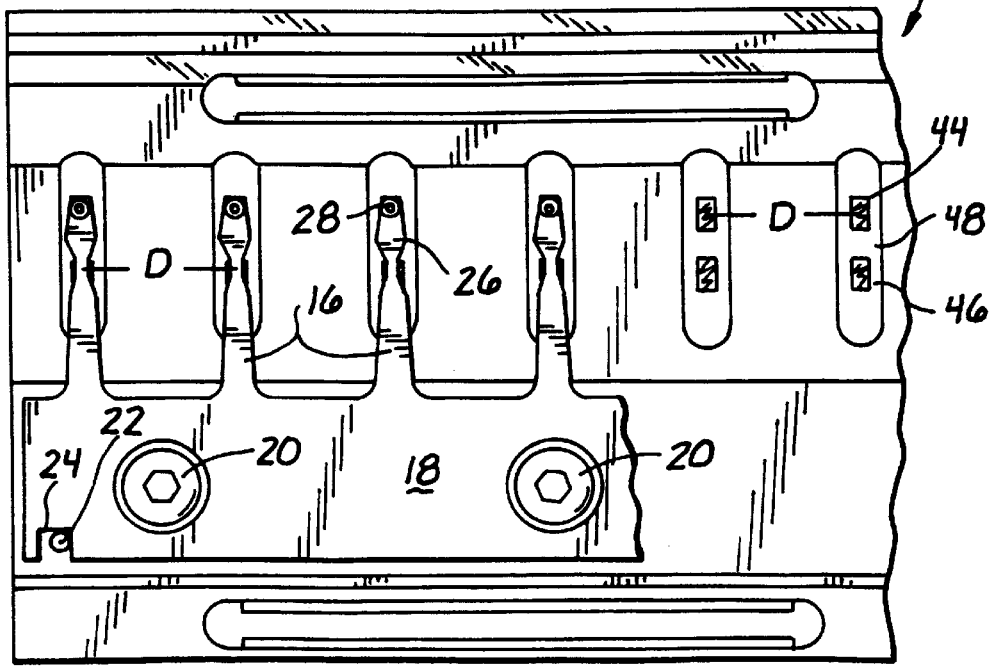
FIG. 4 shows a fragmented front elevation view of the hammerbank of this invention.

Looking more particularly at FIGS. 6 and 7, it can be seen that the terminal points or magnetic contact portions of the pole pieces 44 and 46 are shown with the impact or wear resistant portions 48. These two particular showings in FIG. 6 and 7 show the fundamental upper and lower pole pieces namely pole pieces 52 and 54 of the prior art. Pole pieces 52 and 54 are such wherein they terminate rearwardly distally from the hammers in a notch, gap, groove or space 56. Within the space 56, a single permanent magnet 58 is shown having the north south orientation as seen in FIGS. 6 and 7, and known in the prior art.

The upper and lower pole pieces or pole pins 52 and 54 are respectively wound with an upper coil 62 and a lower coil 64 that is seen whereby it wraps around the pole pieces. The coils 62 and 64 are in series and connected to a voltage source on wire lead 70 which terminates in series at the end of the winding at wire lead 72. Both of these wire leads can be seen connected by wires 74 and 76.

The magnet 58 of the prior art shown in FIGS. 6 and 7 allows for a magnetic circuit to pass through the pole pieces 52 and 54 through the pole piece ends or magnetic hammer contacts 44 and 46 against which the hammers or hammer-springs 16 are retained. This tends to draw or retract the hammers 16 back by the permanent magnetism. The hammers 16 are retained thereagainst until they are released by an opposite magnetic force. This allows the spring action of the hammers or hammersprings 16 to cause them to be released and move forwardly to allow the pin 40 to strike the print ribbon. It should be understood that the hammers 16 need not make absolute touching contact with the contacts 44 and 46, but need only magnetic retention. Sometimes a slight air gap is utilized depending upon design and in some instances to employ the wear surface 48 as the impact receiving contact member.

Generally, it has been customary to attach or magnetically couple the magnetics 58 of the prior art in the area, space groove or notch 56 to allow for the magnetic current to flow through the pole pieces respectively 52 and 54. In this matter the magnetic circuit is fundamentally from the magnet 58 through pole piece 52 to its end 44, then through the hammer 16 back through pole piece end 46 again through pole piece 54 and through the magnet for the magnetic circuit. Opposite orientations can be assumed as to the north (N) south (S) orientations in any manner such that the magnetic circuit can be oriented to pass in the opposite direction. Of course the release voltages must be connected through the coils 62 and 64 to accommodate this orientation.

Be that as it may, the major problem with the magnetics is that each respective pole piece 52 and 54 adjacent to its adjoining pole piece 52 and 54 creates permeance. This causes mutual and self inductance which diminishes the effectiveness of the hammer action because of the magnetic circuit variability due to the dynamics and other factors. Oftentimes, the mutual inductance between pole pieces and hammers can be such where it cascades through the respective adjacent interfacing pole pieces and hammers thereby causing imbalanced performance. To eliminate this, the invention specifically has removed the magnet 58 from its orientation as well as diminishing the general surface area seen in FIG. 7 between pole pieces 52 and 54. This general surface area which has been eliminated is shown in the cross hatched portions namely surface areas 90 and 92. By eliminating surface areas 90 and 92 of the pole pieces 52 and 54, the overall interfacing area of adjacent pole pieces is thereby diminished.

As previously stated in the preamble of the invention, the permeance is inversely proportional to the distance D between the pole pieces and directly proportional to the facing areas of neighboring pole pieces. By eliminating the cross hatched areas 90 and 92, this provides for directly proportionally diminishing interfacing areas thereby creating less permeance and less correlative mutual and self inductance.

As in the prior art and in this invention the volume and the pole piece design with respect to the permanent magnets should be such where the pole pieces never reach saturation. When designed accordingly as to the saturation, the respective geometry in side-by-side interfacing adjacent areas and spring then comes into its major effect.

The principle of eliminating the areas 90 and 92 allows for closer spacing D of the pole pieces and attendant hammers 16 for greater dot matrix concentration and improved operation. With more hammersprings 16, an increased printing speed is provided as well as superior performance and accuracy with respect to the tips 40 striking the ribbon. Thus, the invention relies upon the elimination of the cross hatched areas 90 and 92 of FIG. 7 which comports with the area as seen in FIG. 8 within the left side of the figure. This is the distal areas from the pole piece ends 44 and 46.

The net result is that by reducing the mutual and self inductance between pole pieces 52 and 54 of hammer 16 and the neighboring pole pieces and hammers; the hammers 16 can be released up to thirty six (36%) faster. Further to this extent, the retraction forces are increased so that operational cycle times of the movement of hammers 16 of the hammerbank can be improved upwards to fifteen percent (15%). Of course with less required time for release the total energy to overcome the permanent magnetism necessary for driving the coils 62 and 64 results in less power. It has been found that upwards of twelve percent (12%) less power is required.

Figure 3:
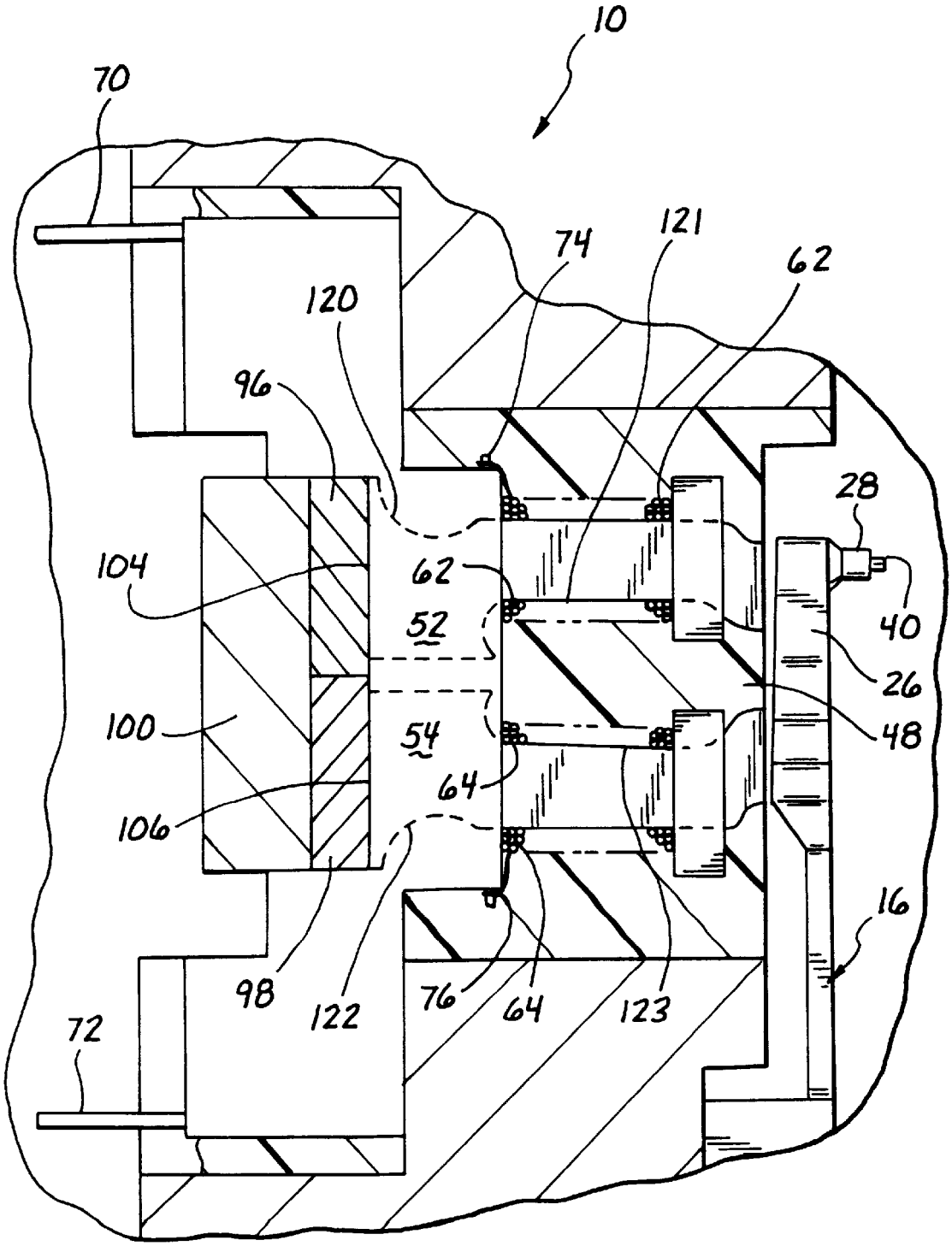
FIG. 3 shows an enlarged sectional view of the invention hereof with the pole pieces having a reduced area, and wherein the hammer has been released for purposes of printing.
Figure 5:
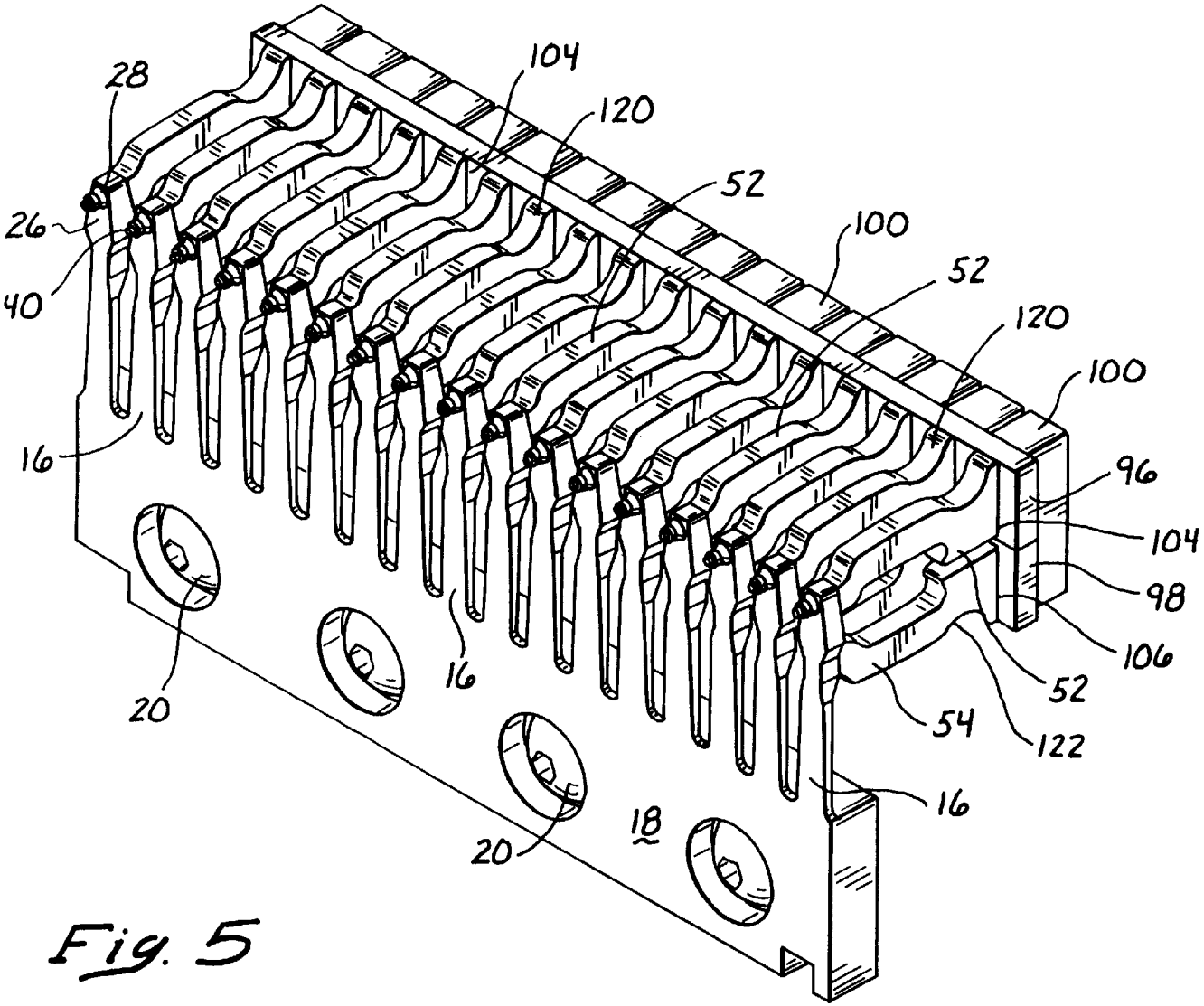
FIG. 5 shows a perspective view of the internal portions of the pole pieces, split magnets, keepers, and hammers of the hammerbank of this invention.

Looking more specifically at FIG. 8 and of course the representation that can be more readily seen in FIGS. 2, 3, and 5, it is seen that magnet 58 has been split in part into two elongated magnets namely magnets 96 and 98. Magnets 96 and 98 both respectively incorporate a magnetic circuit of south (S) to north (N) and again north (N) to south (S) so that magnetic flow can pass between them by means of a magnetic circuit connector or keeper 100. For optimum performance, the magnets should not drive the pole pieces 52 and 54 into saturation The split magnets 96 and 98 which are fundamentally a split of magnet 58 within the space 56 when divided in half allows for the two respective magnets to be placed against the distal rearward ends 104 and 106 of the pole pieces 52 and 54. The pole pieces 52 and 54 have removed flattened surfaces 104 and 106 forming the distal ends that allow placement of the split magnets 96 and 98 thereagainst to provide in turn for a magnetic circuit through the pole pieces 52 and 54. This is also due to the magnetic circuit connector or keeper 100 that allows for the flow from magnet 96 to go south (S) north (N) and to the flow of the respective south (S) north (N) relationship of the second magnet 98.

Here again, the leads and terminals 70 and 72 are utilized to allow for conduction of driving voltage through the connections 74 and 76 to the respective coils 62 and 64. Thus the net result is that the increased performance as previously stated is delivered at the pole piece ends or hammer contacts as contactors 44 and 46 to allow for the various enhancements of improved retraction, speed of operation, and overall effectiveness.

The foregoing configuration of FIG. 8 can be seen more readily in the showing of FIGS. 3 and 5. In particular, FIG. 5 shows the hammerbank fret(s) 18 secured by means of screws, nuts or bolts 20. The hammerbank fret 18 terminates in the upward projecting hammers 16. The hammers 16 have the attendant enlarged portions 26 and necked down intermediate portions 30 serving a dominant spring function with the pins 28 having the striking portions or tips 40.

In FIGS. 3 and 5 it can be seen that the pole pieces 52 and 54 are shown respectively on the top and the bottom. In these particular embodiments, it can be seen that exterior concavities or reduced areas 120 extending in depth cross-sectionally inward on the top and exterior concavities or reduced areas 122 extending in depth cross-sectionally inward on the bottom pole piece are shown. Interior concavities 121 and 123 extending in depth outwardly reduce the overall exposed surface between pole pieces 52 and 54. The side exposure of adjacent areas is reduced. The interfacing areas, which as previously stated, increase permeance directly as they increase in area, allows for the reduction of permeance. Thus the decreased area between the respective pole pieces 52 and 54 in adjoining relationship is reduced thereby creating less permeance and attendantly less mutual inductance.

The magnetic orientation of magnets 96 and 98 that have been split from the same magnet 58 is shown. Also, the attendant magnetic circuit connector or keeper portion 100 can be seen maintaining each respective magnet 96 and 98 in its magnetic circuit relationship. It can be seen that the flat surface areas 104 and 106 are shown with their respective magnets 96 and 98 imposed against them with the magnetic circuit connector or keeper 100 not only providing for the magnetic flow of the magnetic circuit but also maintaining the magnets 96 and 98 against the flat distal pole piece surfaces 104 and 106.

The foregoing configuration as to the pole pieces 52 and 54, magnets 96 and 98, and magnetic circuit connector or keeper 100 are potted into a configuration that can be seen in the FIGS. 1, 2, 3 and 4. The potting material is shown surrounding the magnets 96 and 98 and the terminal portions of the pole pieces 44 and 46 extending therefrom.

A larger showing is illustrated in FIG. 3 wherein a section through the hammerbank 10 has been shown elucidating the placement of the split magnets 96 and 98. Also, the magnetic circuit connector or keeper 100 is shown. The flattened portions 104 and 106 of the pole pieces 52 and 54 are also shown. The coils 62 and 64 are in part detailed around each pole piece 52 and 54. Also, electrical terminals 74 and 76 can be seen at the interconnects of the coils 62 and 64.

In addition to the foregoing, it can be seen that the concavities or reduced areas 120 and 121 for the upper pole piece 52 are shown with concavities or reduced areas 122 and 123 of the lower pole piece 54. Although, these reduced areas 120, 121, 122, and 123 have been shown as concave arcuate portions, they can be notched, rectangular, or angled in any particular manner. The desired result is that they can provide a reduced interfacing area between the respective pole pieces 52 and 54 in their adjacent relationship to their next pole piece. Reduction of the adjoining interfacing areas directly reduces the permeance and related mutual inductance. Thus a necked down or reduced area along the pole pieces 52 and 54 serve the purpose of reducing mutual inductance.

Also, as seen by the flat interfacing surfaces 104 and 106, the entire prior art interfacing areas 90 and 92 as seen in FIG. 6 have been eliminated. Thus, the surface areas of the pole pieces 52 and 54 have been reduced, thereby reducing the permeance and mutual inductance. When this is incorporated with the necked down portions 120, 121, 122, and 123 of the pole pieces 52 and 54, it can be seen that a substantial improvement is provided as previously referred to with regard to the state of the art.

From the foregoing, it can be seen that the configuration as to the split magnets as well as the necked down areas 120, 121, 122, and 123 and the flattened areas 104 and 106 with the attendant magnets are a broad step over the art. Each one individually provides an added feature in the form of the reduced side-by-side area of interfacing exposure between the respective pole piece pairs 52 and 54. In effect the distance D between pairs of pole pieces can be reduced without the effect of added permeance and mutual and self induction. Thus with the reduction in D, a greater number of pairs of pole pieces and hammers can be utilizd in a given length of the hammerbank 10. Further to this extent, they improve the operation through the orientation of the split magnets and the magnetic circuit connector or keeper 100 which enhances magnetic flow. As a consequence, this invention should be broadly construed as to the various features with respect to the independent and dependent claims hereinafter set forth.

We claim:

1. A line printer comprising:

pairs of pole pieces wherein each pole piece has an end for magnetically contacting a print hammer, and a distal end removed therefrom, and;

each of said distal ends is adapted for receiving a magnet and each has a separate magnet against its distal end.

2. The line printer as claimed in claim 1 further comprising:

a reduced area on each of said pole pieces extending in depth away from an area between said pole pieces wherein said reduced areas face each other.

3. The line printer as claimed in claim 1 further comprising:

each of said pole pieces has a reduced area extending inwardly in depth toward an area between said pole pieces.

4. The line printer as claimed in claim 1 wherein:

each pole piece has an area reduced in cross-section facing each other.

5. The line printer as claimed in claim 1 further comprising:

flattened distal terminal ends of said pole pieces wherein each flattened end is adapted for and receives said magnet in the form of an elongated bar magnet.

6. The line printer as claimed in claim 1 further comprising:

each separate magnet is oriented and formed to provide magnetic circular flow through one pole piece to the other.

7. The line printer as claimed in claim 6 further comprising:

a reduced cross-section to each of said pole pieces extending inwardly toward an area between said pole pieces.

8. The line printer as claimed in claim 6 further comprising:

a reduced cross-section to each of said pole pieces extending outwardly from an area between said pole pieces.

9. The line printer as claimed in claim 1 further comprising:

a metallic magnetic circuit connection between said magnets.

10. An impact printer comprising:

a plurality of hammers in side-by-side relationship;

a pair of pole pieces in associated relationship with each of said hammers each pole piece having a hammer magnetic contact and a distal end therefrom removed from said hammer magnetic contact end;

separate magnets spanning a plurality of each of said pole pieces at the distal ends; and, a connection between said magnets for creating a magnetic circuit between each of said pole piece pairs.

11. The line printer as claimed in claim 10 further comprising:

each connection is a metallic member associated with each pair of pole pieces.

12. The line printer as claimed in claim 10 further comprising:

each pole piece having a flattened distal end.

13. The line printer as claimed in claim 10 further comprising:

each pole piece has a depression on its exterior surface extending inwardly toward the area between each pair of pole pieces.

14. The line printer as claimed in claim 10 further comprising:

each pole piece has a depression on the interior surface thereof extending outwardly away from the area between each pair of pole pieces.

15. The line printer as claimed in claim 10 further comprising:

each pole piece has a coil wrapped around it and a necked down area between the magnet and the coil.

16. An impact line printer comprising:

an elongated hammerbank member having a channel;

openings through said elongated member;

pairs of pole pieces placed through said openings having magnetic contact ends exposed for contacting print hammers;

hammers oriented and attached to said elongated member for magnetic contact with said pole piece ends;

distal ends of said pole pieces removed from said hammer magnetic contact surfaces; and at least two permanent magnets within the channel of said elongated member for contact with the distal ends of said pole pieces.

17. The line printer as claimed in claim 16 further comprising:

said at least two permanent magnets in said channel, contact the distal ends of a respective pole piece and wherein each half portion of said pole pieces are in side-by-side relationship; and, contact means between each of said magnets for creating a magnetic circuit.

18. The line printer as claimed in claim 16 further comprising:

pole pieces having at least a portion of the distal ends flattened for receiving said magnets thereagainst.

19. The line printer as claimed in claim 17 wherein:

said magnets are oriented with respect to said pole pieces to provide a north south magnetic flow through tea connector between said magnets.

20. The line printer as claimed in claim 19 further comprising:

said magnets provide connected magnetic flow through the magnetic contact means.

21. The line printer as claimed in claim 17 further comprising:

exteriorly extending reduced cross-sectional areas on the interior surfaces of said pole pieces.

22. The line printer as claimed in claim 17 further comprising:

interiorly extending reduced cross-sectional areas on the exterior of said pole pieces.

23. The line printer as claimed in claim 17 further comprising:

pole pieces having exterior reduced cross-sections reduced toward the interior and interiorly oriented cross-sections wherein the interior is reduced toward the exterior.

24. A method for providing line printing comprising:

providing an elongated member;

providing a plurality of print hammers on said elongated member;

providing pairs of pole pieces having hammer contact ends wherein said pole pieces extend through the cross-section of said elongated member;

providing a magnet to each pole piece of said pair of pole pieces; and, providing magnetic circuit flow from one magnet through a pole piece to a second pole piece of the pair of pole pieces and then back to said second magnet.

25. The method as claimed in claim 24 further comprising:

connecting said magnets with a magnetic connector.

26. The method as claimed in claim 24 further comprising:

reducing the interfacing cross-sections of said adjacent pole pieces.

27. The line printer as claimed in claim 1 further comprising:

maintaining the size of said pole pieces with respect to said magnets below saturation.

28. The line printer as claim in claim 10 further comprising:

maintaining the magnetism of said magnets below that necessary to saturate said pole pieces.

29. The method as claimed in claim 24 further comprising:

magnetically driving said pole pieces by said magnets at or below saturation.

* * * * *